US005509158A

United States Patent [19]

Morrison

[11] Patent Number: 5,509,158

[45] Date of Patent: Apr. 23, 1996

[54] BED SUPPORTED STORAGE PLATFORM

[76] Inventor: William L. Morrison, 273 Calliope Dr., Henderson, Nev. 89014

[21] Appl. No.: 440,243

[22] Filed: May 12, 1995

[51] Int. Cl.[6] ..... A47C 21/02

[52] U.S. Cl. ..... 5/504.1; 5/507.1

[58] Field of Search ..... 5/504.1, 503.1, 5/505.1, 506.1, 507.1

[56] References Cited

U.S. PATENT DOCUMENTS

| | | | |
|---|---|---|---|
| 272,077 | 2/1883 | Mueller . | |
| 355,911 | 1/1887 | Bartow . | |
| 713,529 | 11/1902 | Swindell . | |
| 884,204 | 4/1908 | Piper . | |
| 905,702 | 12/1908 | Hunter . | |
| 1,267,046 | 5/1918 | Beaird . | |
| 1,347,271 | 7/1920 | Hartman . | |
| 1,348,481 | 8/1920 | Chomos . | |
| 1,435,166 | 11/1922 | Kuczynski . | |
| 1,957,165 | 5/1934 | Gingras . | |
| 2,859,454 | 11/1958 | Beckwell . | |
| 3,196,468 | 7/1965 | McWilliams . | |
| 3,276,731 | 10/1966 | Orchard . | |
| 3,435,469 | 4/1969 | Fricke | 5/504.1 |
| 3,961,385 | 6/1976 | Ferry | 5/504.1 |
| 4,819,568 | 4/1989 | Coffrin . | |
| 4,841,589 | 6/1989 | Moore | 5/504.1 |
| 5,038,434 | 8/1991 | Navarrette | 5/507.1 |
| 5,329,658 | 7/1994 | Fontenot et al. | 5/505.1 |

*Primary Examiner*—Alexander Grosz
*Attorney, Agent, or Firm*—Quirk & Tratos

[57] ABSTRACT

A bed supported storage platform comprises a support structure for mounting to the end of a bed and a platform on which items may be stored. The support structure preferably comprises a pair of spaced apart vertically extending posts and a strut extending from each post outwardly between the mattress and box spring of a bed. The platform is rotatably connected to the posts and is moveable between a stored position in which it extends downwardly along the posts and the end of the bed, to a raised position in which it extends outwardly from the bed in generally the same plane as the top surface of the mattress.

9 Claims, 4 Drawing Sheets

BED SUPPORTED STORAGE PLATFORM

FIELD OF THE INVENTION

The present invention relates to a bed supported platform useful in storing items such as bedding and the like at the end of a bed.

BACKGROUND OF THE INVENTION

A recurring problem for users of beds involves temporarily storing certain bedding when not in use. For example, a user often wishes to remove from the bed and temporarily store bed coverings such as quilts, blankets and bedspreads, and other bedding such as extra pillows and similar items.

The necessity of temporarily storing such items is common. Today, many bedspreads and pillows are for decorative use only, and must be removed by a user of the bed. Also, when it is hot and a user of the bed requires less covering, the user often wishes to temporarily remove quilts or blankets.

Currently, most bed users either store the bedding on the floor or a dresser, or push them to the foot of the bed. Temporary storage of unused bed coverings in these manners suffers drawbacks, however. When located on the floor, the unused bed coverings often obstruct a walking path, and can get soiled.

A user who wishes to store the items on a dresser must have a large dresser with a flat surface, which must be kept clear of other items. This often requires the user to clear the top of the dresser each time he wishes to store the bed coverings. Further, because the dresser is often not adjacent the bed, the user must fold or stack the items and walk them over to the dresser.

When located at the foot of the bed, the user of the bed often kicks the items onto the floor during sleep, or is uncomfortable under the weight of the items on his legs and feet.

In each of the above-instances, with the exception of placement of the items at the foot of the bed, if the user wishes to retrieve the bedding item he must get up out of bed to get it. This is inconvenient when the user is still in bed, such as when a user becomes cold and requires the stored quilt or blanket.

A need exists for a method and device for storing items such as bed coverings off of the bed. This same device must be readily accessible from the bed and preferably is hidden from view and takes up little space when not in use. It is also desired that a user be able to easily attach and remove the device from the bed and move it to other beds.

SUMMARY OF THE INVENTION

The present invention is a bed supported storage device comprising a support structure for supporting the device at the end of a bed and platform on which items may be supported. The support structure includes a bed-engaging portion and platform supporting portion.

The platform supporting portion comprises a pair of spaced upright posts. The bed-engaging portion of the support structure preferably comprises a pair of struts, one each of which extends from one of the posts outwardly between the mattress and box spring of a bed.

The platform comprises an outer frame and inner support surface. The frame is preferably a rectangular tubular member having a width substantially equal to the width of a bed the device is used with. The support surface comprises a number of spaced apart slats extending between sides of the platform frame.

Advantageously, the platform is connected to the posts with hinges, allowing a user to move the platform between a first raised position in which it extends outwardly from the end of a bed, to a second stored position in which it extends downwardly along the end of the bed. Means for supporting the platform in its raised position comprise folding arms connecting each post with the platform frame.

In use, a user positions the device at the end of the bed with the struts extending between the mattress and box spring. When not in use, the user folds the platform downwardly along the posts and the end of the bed. In this position, the device is flat and compact, and can be hidden from view underneath the comforter or bedspread which overhangs the end of bed.

When a user desires to use the device, he raises the platform upwardly, locking the arms in an extended position. In this position, the platform extends outwardly of the end of the bed, preferably in nearly the same plane as the top of the bed. A user then puts bedding or other items to be stored on the platform.

The user can easily change bedding on the bed by sliding the device partially outwardly of the end of the bed, or by removing the device completely from the bed. Further, the user can move the entire device to a different bed and install it thereon simply by positioning the struts between the mattress and box spring of that bed.

Further objects, features, and advantages of the present invention over the prior art will become apparent from the detailed description of the drawings which follows, when considered with the attached figures.

DETAILED DESCRIPTION OF THE PREFERRED EMBODIMENT

Figure 1:
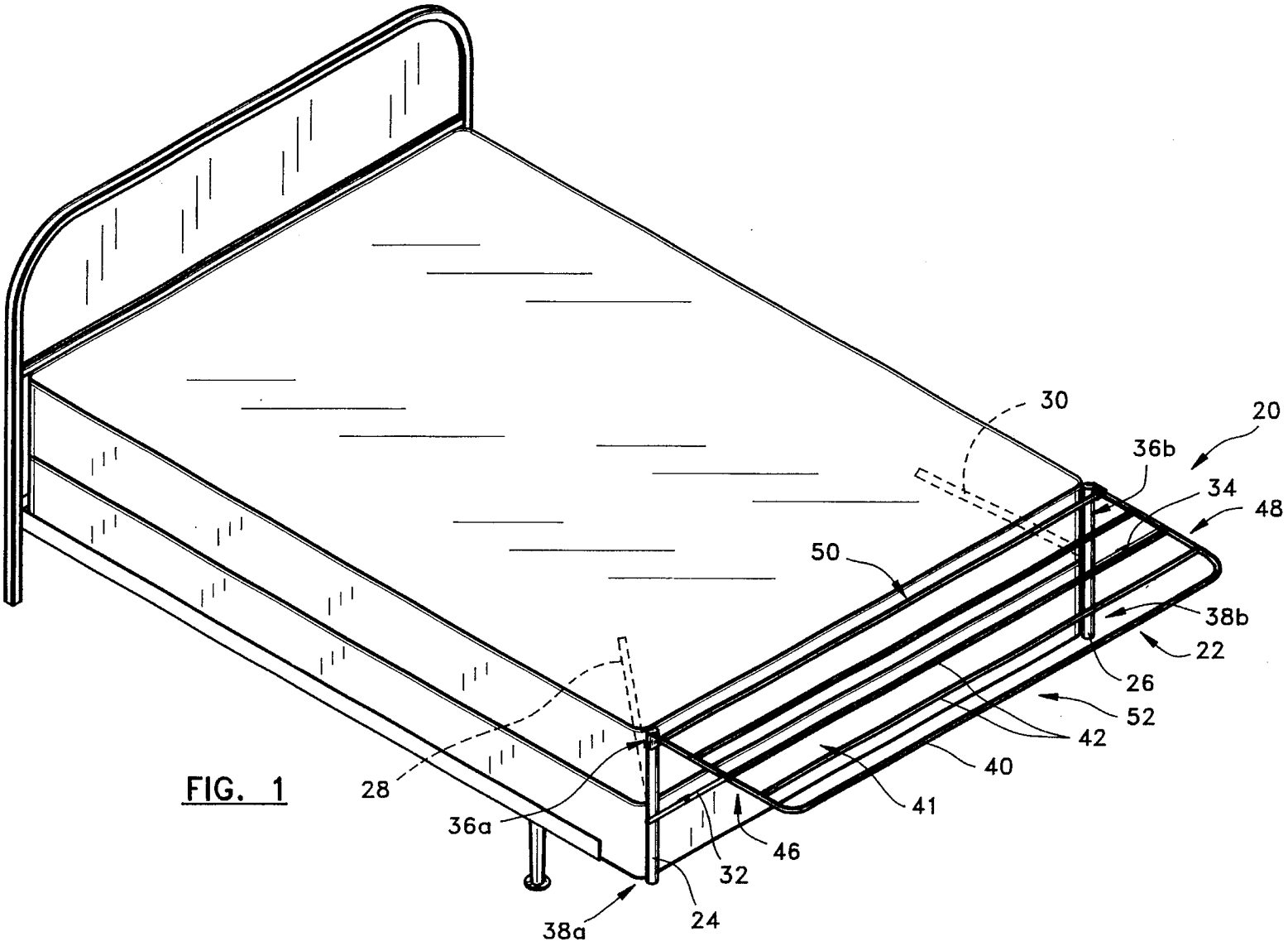
FIG. 1 is a perspective view of a bed-supported bedding storage device of the present invention with a platform thereof illustrated in an extended position.

FIG. 1 illustrates a bedding storage device 20 in accordance with the present invention. In general, the device 20 comprises a storage platform 22 hingedly connected to two vertically upstanding posts 24,26. Struts 28,30 extend outwardly from the posts 24,26 for location between the mattress and box spring of a bed for supporting the device, including the platform 22 and any bedding stored thereon. A folding arm 32,34 connects each post 24,26 and the platform 22 for use in supporting the platform in raised position.

A user places the device 20 at the end of a bed, with the struts 28,30 extending inwardly between the mattress and box spring of a bed. The user moves the platform 22 from a first lowered or "stored" position in which it extends downwardly along the end of the bed perpendicular to the top surface of mattress (i.e. downwardly towards the floor), to a second raised "use" position in which it extends outwardly of the bed in the same plane as the top of the mattress.

When the platform 22 is in the lowered position, the hinged arms 32,34 fold upon themselves and extend along each post. In the platform's raised position, the arms 32,34 lock in an extended position between the platform and posts, supporting the platform. Advantageously, when the platform 22 is in its stored position, the device 20 can be completely hidden from view underneath a bedspread or comforter which covers the bed.

Further advantage of the device 20 include the simple manner by which the device engages the bed for support, allowing a user to easily remove the device from a bed to change bed coverings or the like. The device 20 is also easily moved to a different bed for the same reason.

More particularly, and referring again to FIGS. 1–5, the device includes a platform 22 connected to a support structure. In general, the support structure comprises a platform support portion in the form of the two posts 24,26, and a bed-engaging portion comprising two struts 28,30.

The exact length of each post 24,26 is preferably equal to the depth of the mattresses or mattress and box spring the device 20 is used with. The posts 24,26 are preferably made of light-weight tubular metal, although they made be made of plastic, wood, or other suitable materials.

When the device is installed on a bed, the posts 24,26 extend substantially in a vertical direction, such that the posts each have a top end 36*a,b* and bottom end 38*a,b*. The posts 24,26 thus extend with their top ends 36*a,b* adjacent the top surface of the mattress, and their bottom ends 38*a,b* near the bottom surface of the bed.

Means for removably mounting the device 20 on, or connecting the device to, a bed preferably comprises two struts 28,30. The struts 28,30 extend, one each, from the posts 24,26. The struts 28,30 extend nearly perpendicular to the posts 24,26, or in other words, in a plane which is parallel to the top and bottom surfaces of the mattress/box spring of the bed when the device is installed on the bed.

While the struts 28,30 generally extend in the same horizontal plane, they extend in different vertical planes from one another. In particular, the struts 28,30 extend inwardly towards one another at an angle between about 10 and 45 degrees with respect to a vertical plane passing through each post and extending parallel to the lengthwise dimension of the bed. In other words, the struts 28,30 generally extend inwardly towards the center of the bed.

The struts 28,30 are preferably comprise metal members which extend from the post 24,26 in rigid fashion, welded to the posts when each is made of metal.

The struts 28,30 are connected to the posts 24,26 between their top and bottom ends in a position whereby the platform 22, when in its raised position, is substantially in the same plane as the top surface of the mattress. For example, when the device 20 is mounted on a bed having a mattress with a depth of about 8 inches, the struts 28,30 preferably extend from the posts 24,26 about 8 inches downwardly from the top end 36*a,b* thereof.

The platform 22 is movably connected to the posts 24,26, and supported on the bed by the support structure. The platform 22 is a generally rectangular-shaped member comprised of an outer frame 40 surrounding an inner support surface 41. Preferably, the support surface 41 comprises a number of longitudinally extending slats 42.

As illustrated in FIG. 1, the frame 40 of the platform 22 is constructed of tubular metal about 0.5–1 inches in diameter. The platform 22 has a first side 46 and a second side 48 corresponding to the sides of the bed, and a first end 50 and a second end 52. The width of the frame 40 from side-to-side 46,48 is preferably identical to the width of the bed on which the device 20 is used. For example, if the device 20 is used on a "queen"-sized bed, the platform 22 is preferably about 60 inches in width. Regardless of the size of the bed on which the device 20 is used, the length of the platform 22 is about 10–30 inches.

The support surface 41 of the platform 22 preferably comprises a number of spaced slats 42 extending the width of the frame 40 from side-to-side. The slats 42 are preferably constructed of tubular metal about 0.1–0.5 inches in diameter, and are spaced (as measured outer surface to outer surface) about 1–6 inches apart. Each slat 42 is attached, such as by welding or the like, to the sides 50,52 of the frame 40.

Figure 3:
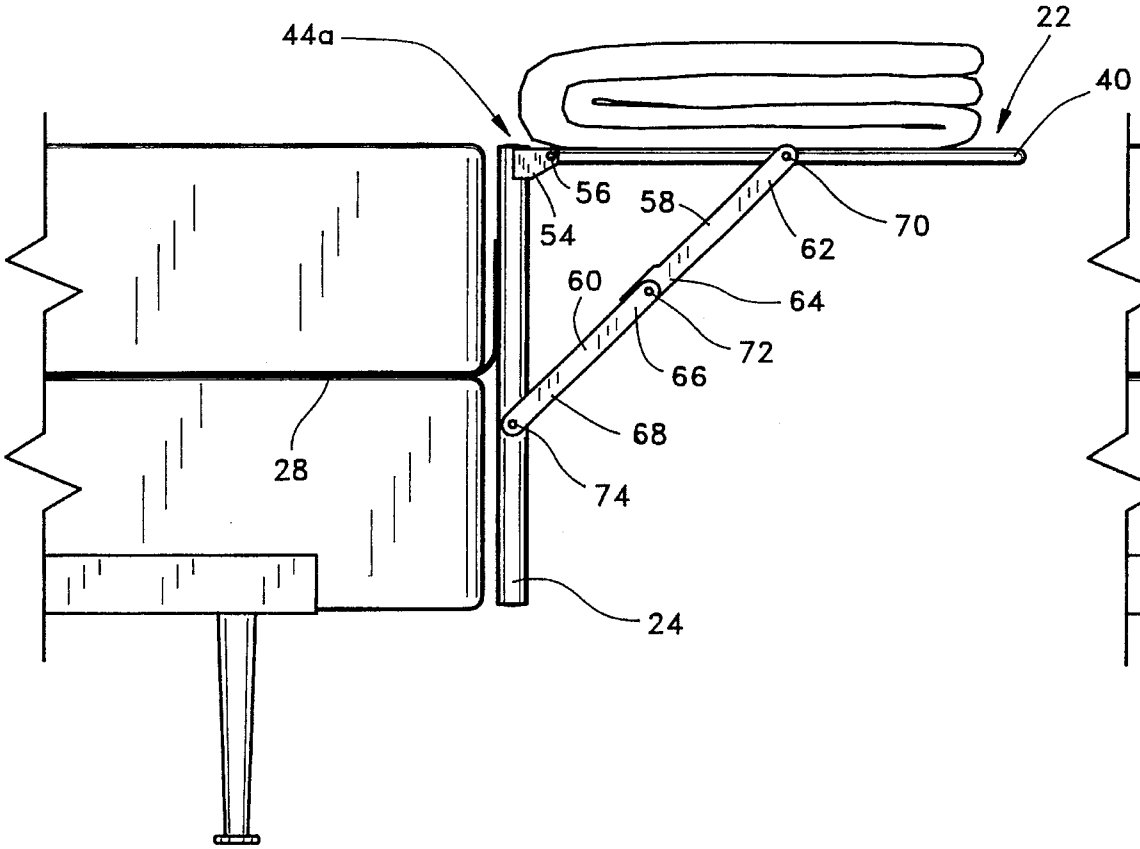
FIG. 3 is a side view of the device illustrated in FIG. 1.

The device 20 includes means for moving the platform 22 between a stored position in which it extends downwardly along the posts 24,26 towards the floor and a raised position in which it extends outwardly generally parallel to the top surface of the mattress. As illustrated in FIGS. 1 and 3, these means preferably comprise hinges 44*a,b* connecting the platform 22 to the top end 36*a,b* of each post.

Figure 5:
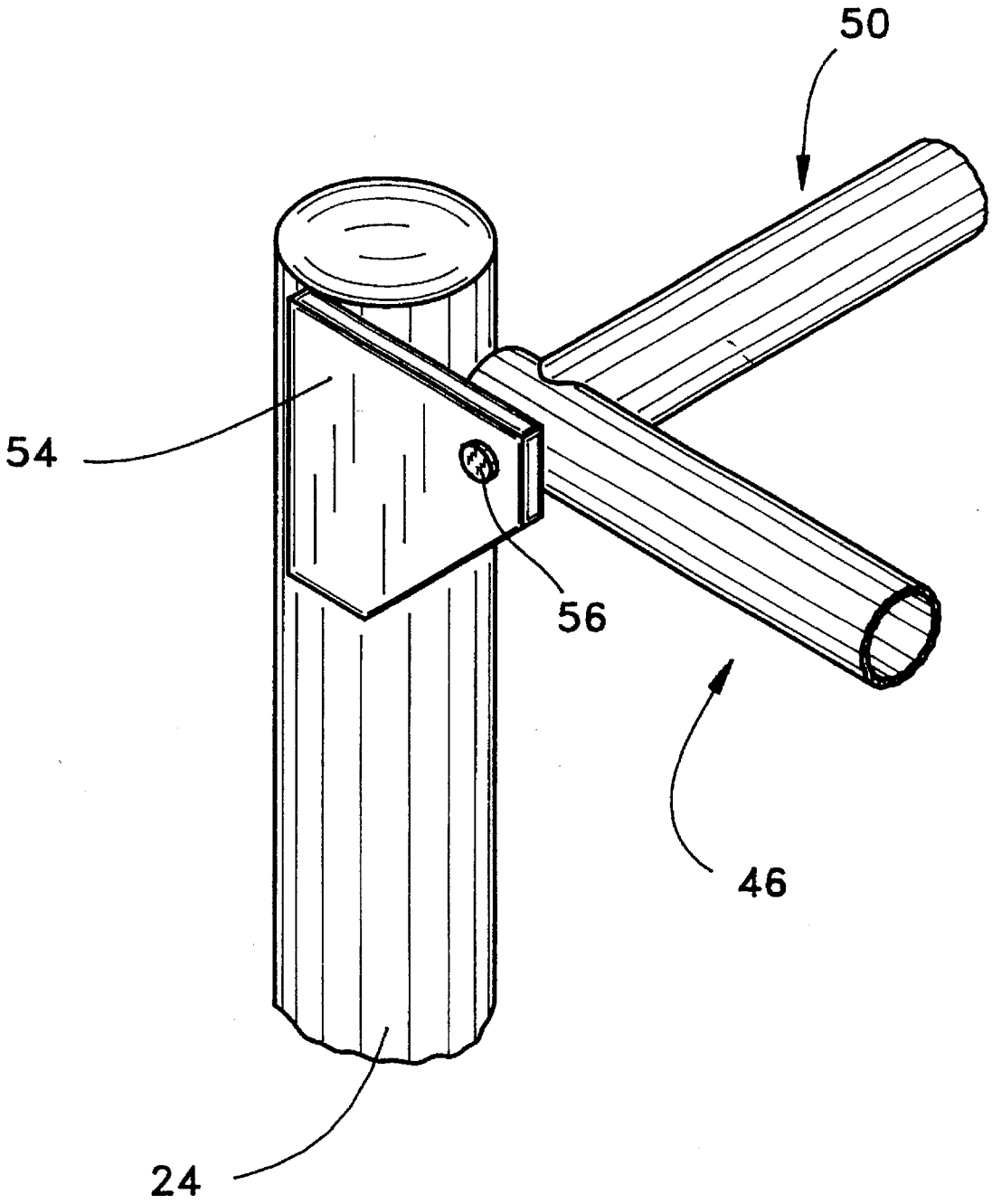
FIG. 5 illustrates a hinge connection between the platform and a support post.

Each hinge 44*a,b* preferably comprises a connecting plate 54, and a pin 56. As illustrated in FIG. 5, the plate 54 is a flat, preferably metal member securely attached to the post. The pin 56 extends through a portion of the plate 54 extending beyond the post, into the frame 22. Because the platform 22 is freely connected to the hinges 44*a,b* on the posts 24,26, the platform 22 normally rests freely in its stored position, extending downwardly along the posts.

The device 20 includes means for retaining the platform 22 in a raised "use" position. Preferably, the means comprises arms 32,34 extending between each post 24,26 and the frame 40 of the platform 22. Each arm 32,34 comprises a hingedly connected first segment 58 and second segment 60. The segments 58,60 are each thin, rigid metal members.

The first segment 58 has a first end 62 rotatably attached to the frame 40 of the platform 22, preferably approximately midway along the side thereof. In particular, a pin 70 passes through the segment 58 into the frame 40, allowing the segment to rotate with respect to the frame.

The first segment 58 includes a second end 64 hingedly connected to a first end 66 of the second segment 60. In particular, the ends 64,66 of the segments 58,60 are rotatably connected by a pin 72 passing through the segments.

In order to prevent over-rotation of the segments 58,60 with respect to one another from the position illustrated in FIG. 3, a stop 73 comprising an outwardly extending ledge is located on the second end 64 of the first segment.

The second segment 60 includes a second end 68 connected to the post. In particular, a pin 74 extends through the segment 60 and into the post 24,26, allowing the segment 60 to rotate with respect to the post.

Use of the device 20 of the present invention is as follows. First, a user places the device 20 at the end of a bed. The user inserts the struts 28,30 of the device between two mattresses or the mattress and box spring of the bed.

Figure 2:
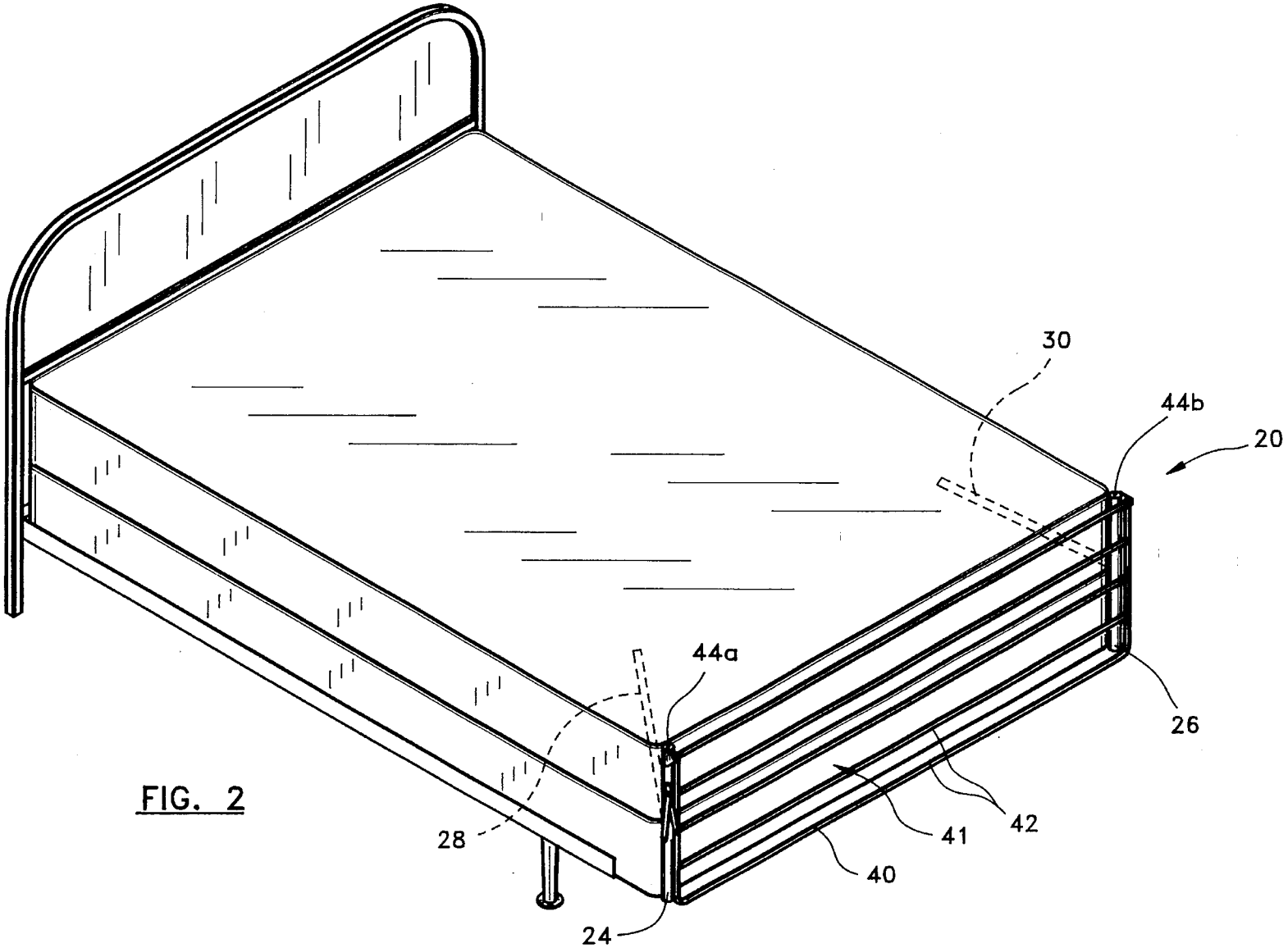
FIG. 2 is a perspective view of the device of FIG. 1 with the platform illustrated in a stored position.
Figure 4:
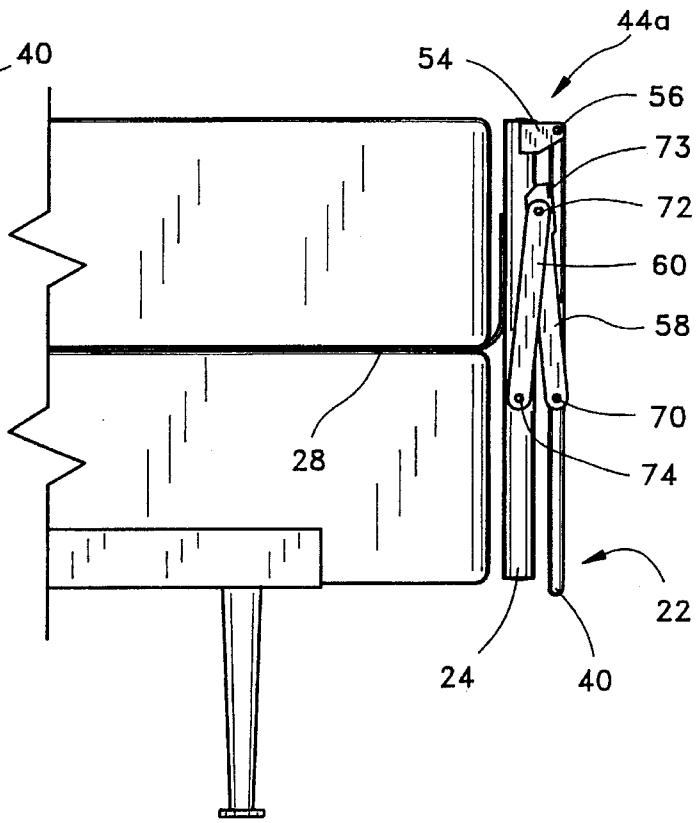
FIG. 4 is a side view of the device illustrated in FIG. 4.

When not in use, the platform 22 of the device 20 is preferably in the position illustrated in FIG. 2. In this position, the platform 22 extends downwardly along the end of the bed towards the floor. When the platform 22 extends downwardly, the segments of the arms 32,34 fold upon one another as illustrated in FIGS. 2 and 4.

When folded downwardly into the stored position, the platform 22, posts 24,26, and arms 32,34 are compact and flat, and extend beyond the end of the bed by only a few inches. In this manner the device 20 requires little space within a room.

In use, the user lifts upwardly on the platform 22 until it is in the position illustrated in FIGS. 1 and 3. When in the raised "use" position, the platform 22 extends outwardly of the end of the bed, in substantially the same plane as the top surface of the mattress. When the user extends the platform 22 outwardly, the arms 32,34 unfold, forming support braces for the platform.

Advantageously, when the platform 22 is in a raised position, the platform acts a support surface to and from which a user can easily slide bedding on or off a bed. Further, the location of the platform 22 adjacent the end of the bed allows a user to easily move items to the platform, or retrieve them therefrom, while in bed.

The user may place a quilt, comforter, pillows or other bedding or similar items on the platform 22 for storage. For example, the device is useful in hotels and the like as a platform on which luggage or similar items may be stored.

When the platform 22 of the device 20 is in its stored position, the device is flat and compact, extending past the end of the bed by only a short distance. Advantageously, this allows a user to cover the device 20 which a comforter, bedspread or other covering, completely hiding the device from sight when not in use.

The manner by which the device 20 is supported by the bed also allows a user to easily remove the device from the bed when, for example, the user wishes to change bedding. Further, a user can easily move the entire device to a different bed for use therewith.

While the invention has been described above in the form of a preferred embodiment, variations of the invention are possible and anticipated within the scope of the invention.

For example, the support surface 41 of the platform 22 may comprise solid material such as a wood or metal sheet. Additionally, it is possible to eliminate the need for a separate platform frame 40 depending on the type of support surface 41 used. For example, a frame is not necessary if the support surface 41 comprises a thick sheet of wood.

The means for supporting the device 20 may comprise elements for attaching the device 20 directly to the frame of the bed, or for supporting the device 20 on the floor.

To prevent the device 20 from rocking back and forth and to stabilize it, the struts 28,30 preferably extend inwardly towards one another and the middle of the bed. It is possible for the struts to extend parallel to the sides of the bed. Alternatively, the struts may comprise a single "U" shaped member extending outwardly from and connecting the posts, or comprise any of a variety of other structures for location between the mattress(es), box spring, and/or frame of a bed.

The stop for preventing over-rotation of the arms may have a variety of other configurations. For example, a slider located on the segments for positioning over the connected ends of the segments, or a locking pin which can be passed through bores in the segments may be used.

While the hinges have been described as plates connecting the posts and platform, a number of other means for rotatably connecting the platform to the support may be used. For example, the platform may simply include extensions passing along the posts which have pins passing through them and the posts.

It will be understood that the above described arrangements of apparatus and the method therefrom are merely illustrative of applications of the principles of this invention and many other embodiments and modifications may be made without departing from the spirit and scope of the invention as defined in the claims.

I claim:

1. A bed supported storage device for storing items at the end of a bed comprising:

a support structure including at least two spaced-apart upright posts;

a platform having a first side and a second side, said first side hingedly connected to said support structure;

at least one folding arm connecting said platform and said support structure, whereby said platform is movable between a first raised position in which said arm is extended and retains said platform in a position in which it extends outwardly from the end of said bed; and a second stored position in which said arm is folded and said platform extends downwardly along the end of said bed; and means for removably connecting said support structure to said bed at an end thereof, said means for removably connecting comprising a pair of struts connected to said support structure and extending outwardly therefrom.

2. The device of claim 1, wherein said struts are elongate for extension between a mattress and box spring of the bed.

3. The device of claim 1, wherein said platform comprises a substantially rectangular frame having an inner support surface, said inner support surface comprising a number of spaced apart slats connected to said frame.

4. The device of claim 1, wherein said folding arm comprises a first segment rotatably connected to said platform and a second segment rotatably connected to said support structure, said first and second segments rotatably connected to one another.

5. A storage device for mounting on a bed comprising:

means for connecting said device to a bed;

means for supporting a platform connected to said means for connecting, wherein said means for supporting comprising at least two spaced-apart posts and said means for connecting comprising a pair of struts extending outwardly from said means for supporting for engagement with a mattress and box spring of said bed;

a platform movably connected to said means for supporting, said platform movable between a first position in which it extends outwardly of the bed to a second position in which it extends downwardly along an end of said bed; and means for retaining said platform in said first position, said means comprising at least two folding arms.

6. A device for storing items at the end of a bed comprising:

a first and a second post;

a strut extending outwardly from each of said posts for positioning by a user between the mattress and box spring of a bed;

a platform having a first end, a second end, a first side and a second side;

a pair of folding arms connecting said platform to said posts; and a pair of hinges connecting said platform and said posts, whereby said platform is movably connected to said first and second post.

7. The device of claim 6, wherein said platform is substantially rectangular in shape and has approximately the same width as a bed on which it is mounted.

8. The device of claim 6, wherein said platform is connected to said posts in a position whereby when said platform is moved to a raised position, it extends outwardly from said bed in approximately the same plane as a top surface of said bed.

9. A method of storing items at the end of a bed, comprised of a mattress positioned on a box spring, on a storage device including a platform movably connected to a support structure, comprising the steps of:

positioning said device at the end of a bed by positioning a pair of struts extending outwardly from said support structure between the mattress and box spring of the bed, with first and second posts of said support structure extending upwardly along the end of said bed;

moving said platform to a first position in which it extends downwardly along the end of the bed;

positioning said device underneath a bed covering on said bed;

raising said platform from said first position to a second position in which it extends outwardly from the end of said bed;

retaining said platform in said second position by unfolding a folding arm connecting said platform and said supporting structure.

* * * * *